US005678633A

United States Patent [19]

Constantine, Jr.

[11] Patent Number: 5,678,633

[45] Date of Patent: Oct. 21, 1997

[54] SHIFTING TOOL

[75] Inventor: Jesse J. Constantine, Jr., Kingwood, Tex.

[73] Assignee: Baker Hughes Incorporated, Houston, Tex.

[21] Appl. No.: 373,659

[22] Filed: Jan. 17, 1995

[51] Int. Cl.[6] ..... E21B 23/00; E21B 23/04

[52] U.S. Cl. ..... 166/319; 166/381; 166/383

[58] Field of Search ..... 166/125, 212, 166/381, 383, 319

[56] References Cited

U.S. PATENT DOCUMENTS

| | | | |
|---|---|---|---|
| 2,328,840 | 9/1943 | O'Leary | 166/125 X |
| 4,312,406 | 1/1982 | McLaurin et al. | 166/386 |
| 4,365,668 | 12/1982 | Bright | 166/212 X |
| 4,811,792 | 3/1989 | Lemboke et al. | 166/381 |
| 4,917,191 | 4/1990 | Hopmann et al. | 166/381 |
| 5,090,481 | 2/1992 | Pleasants et al. | 166/373 |
| 5,156,210 | 10/1992 | Roth | 166/319 |
| 5,183,114 | 2/1993 | Mashaw, Jr., et al. | 166/319 |
| 5,211,241 | 5/1993 | Mashaw, Jr. et al. | 166/320 |
| 5,305,833 | 4/1994 | Collins | 166/386 |

FOREIGN PATENT DOCUMENTS

| | | |
|---|---|---|
| 1601526 | 5/1978 | United Kingdom . |
| 2016062 | 9/1979 | United Kingdom . |

*Primary Examiner*—David J. Bagnell

*Attorney, Agent, or Firm*—Rosenblatt & Redano P.C.

[57] ABSTRACT

A shifting tool is provided which is preferably hydraulically actuated. A built-up hydraulic force overcomes a retaining piston, which, in turn, frees up a pivoting linkage whose movements are opposed by a coil spring. The coil spring urges the pivoting linkage outwardly where contact can be made with the internal groove on a shifting sleeve. The shifting tool can be run in with the linkage in the expanded position since the parts are configured to allow the linkage to retract to clear any internal obstructions before reaching the shifting grooves in the shifting sleeve. The pivoting action of the grip on the groove in the shifting sleeve increases the gripping force when jarring occurs. The parts are configured so that there is a minimum of movement of shifting parts which have seals to further reduce potential wear on pressure seals. A compact design is provided which can be useful on sleeves with a range of internal bores. The coil springs used in the preferred embodiment, which act against the linkage, can be easily replaced to adjust the force of engagement with the internal groove on the shifting sleeve.

20 Claims, 2 Drawing Sheets

SHIFTING TOOL

FIELD OF THE INVENTION

The field of this invention relates to tools useful for shifting sleeves and similar equipment downhole.

BACKGROUND OF THE INVENTION

Sliding sleeves are frequently employed in downhole operations. The sliding sleeves are incorporated in tubing or casing, and when properly positioned in the wellbore such sleeves need to be shifted to open or close ports to accomplish a wide variety of downhole operations. Generally, sleeves have had an internal groove at either end so that a shifting tool could be oriented in one direction to engage one of the grooves and oriented in the well in an inverse orientation to engage the other groove on the shifting sleeve so that movement in the opposite direction could be achieved. These internal shifting grooves on sliding sleeves were engaged by dogs or collets that generally were radially loaded with coil or leaf springs so that they could pass over the end of the shifting sleeve and spring back into the shifting groove for a connection to the sleeve to move it in one direction or the other. Typical of such prior designs are U.S. Pat. Nos. 4,917,191; 5,211,241; 5,183,114; 5,305,833; 5,090,481; and 5,156,210.

The drawback of prior designs is that, as they are biased further outward radially, the motive force keeping them in that position decreases as the coil or leaf spring extends further and further. As a result, the force keeping the dogs, which engage the shifting sleeve in the engaged position, decreases as the dogs move radially outwardly, allowing the springs which drive them to expand. In many prior designs, the dogs were retained in a retracted position until the shifting tool reached the desired location, at which point a retainer would be moved out of the way, allowing the dogs to move outwardly into the shifting grooves on the sliding sleeve.

These prior designs had the drawbacks of not only a reduced pushing force on the dogs as they moved outwardly radially, but also the inherent unreliability of the small coil or leaf springs that had to be used in a very confined space in applications that called for a significant biasing force. Frequently, these springs would be subject to premature failure due to stress cracking or attack from surrounding contaminants.

The use of springs behind the locking dogs to drive them further outwardly also entailed designs which had fairly large profiles, making that type of layout difficult to use in applications requiring smaller diameters where a more compact design was necessary.

The apparatus of the present invention was developed to address the shortcomings of these prior designs. In the present design, a pivoting linkage is employed to engage the shifting grooves in the shifting sleeve. As the linkage expands further outwardly, a greater locking force is applied to the shifting groove. Jarring movements further increase the grip of the shifting tool of the present invention on the shifting sleeve. Additionally, the layout of the components is such that the pivoting linkage can be placed in an expanded position as the shifting tool is lowered toward the shifting sleeve, thereby allowing the linkage to compress as required to clear any obstructions along the way while springing out when finally contacting the groove on the shifting sleeve. The present design moves away from the leaf or small wire springs that had been previously used, and instead adopts a hydraulic actuation system which further involves the use of larger coil springs which provide greater flexibility to adjust the resulting force on the pivoting linkage when contacting the shifting sleeve.

SUMMARY OF THE INVENTION

A shifting tool is provided which is preferably hydraulically actuated. A built-up hydraulic force overcomes a retaining piston, which in turn frees up a pivoting linkage whose movements are opposed by a coil spring. The coil spring urges the pivoting linkage outwardly where contact can be made with the internal groove on a shifting sleeve. The shifting tool can be run in with the linkage in the expanded position since the parts are configured to allow the linkage to retract to clear any internal obstructions before reaching the shifting grooves in the shifting sleeve. The pivoting action of the grip on the groove in the shifting sleeve increases the gripping force when jarring occurs. The parts are configured so that there is a minimum of movement of shifting pans which have seals to further reduce potential wear on these pressure seals. A compact design is provided which can be useful on sleeves with a range of internal bores. The coil springs used in the preferred embodiment, which act against the linkage, can be easily replaced to adjust the force of engagement with the internal groove on the shifting sleeve.

DETAILED DESCRIPTION OF THE DRAWINGS

FIG. 3 is similar to the view of FIG. 1, but with hydraulic pressure applied as the tool is being run in to indicate that the tool can assume the run-in position when it encounters an obstruction during run in.

DETAILED DESCRIPTION OF THE PREFERRED EMBODIMENT

Figure 1:
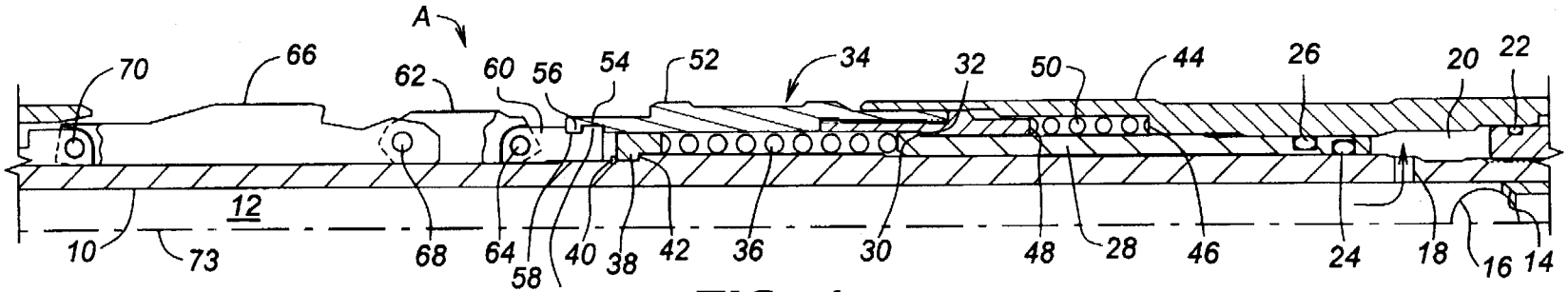
FIG. 1 is a sectional view of the shifting tool in the run-in position.

The apparatus A is shown in the run-in position in FIG. 1. It has a mandrel 10 having a central passageway 12. A ball seat 14 is disposed in passage 12 and is formed to accept a ball or sphere 16 so as to obstruct passage 12 for subsequent pressure build-up. While a ball and seat combination has been described, other mechanisms for obstructing or restricting the passage 12 to facilitate pressure build-up are within the purview of the invention, such as an orifice which creates backpressure when flow is pumped through it.

A lateral port 18 communicates with variable-volume cavity 20. Seals 22, 24, and 26 effectively seal cavity 20. Seals 24 and 26 are located in retaining piston 28. Retaining piston 28 has an outwardly oriented shoulder 30 which is aligned with a shoulder 32 of linkage piston 34. Spring 36 is mounted over mandrel 10 and is supported by ring 38, whose position is retained by retainer 40 against shoulder 42 on mandrel 10. One end of spring 36 bears on ting 38 while the other end bears on retaining piston 28. Sleeve 44 is mounted over mandrel 10, with seal 22 therebetween to sealingly close off one end of cavity 20. Sleeve 44 has an inwardly-oriented shoulder 46, which is aligned with the bottom 48 of linkage piston 34. In the preferred embodiment, springs 36 and 50 are coil springs, with spring 36 being stiffer than spring 50. Spring 50 is disposed between bottom 48 and shoulder 46, and is normally retained in the compressed position shown in FIG. 1 due to the greater force extended against retaining piston 28 by spring 36. Because of this force imbalance, shoulder 30 firmly provides a travel stop to the linkage piston when its shoulder 30 engages shoulder 32 on the linkage piston.

As shown in FIG. 1, the linkage piston 34 can be made of several components and includes an upper segment 52 which contains a depression 54 adjacent its end. Adjacent the depression 54 is a projection 56. Projection 56 is mounted into depression 58 on link 60. Link 60 has a projection 63 which extends into depression 54 of upper segment 52. As can be seen by comparing FIGS. 1 and 2, link 60 translates when the linkage piston 34 is allowed to move, as will be explained below. Link 60 is pivotally connected to link 62 at pin 64. Link 62 is pivotally connected to link 66 by pin 68. Finally, link 66 is fixedly pinned at pin 70 for rotation about pin 70. However, longitudinally pin 70 is stationary. It should be noted that the distance from the centerline 73 to the pin 68 is greater than the distance between the centerline 73 and the pin 64. As a result of this centerline distance difference, translational movement of linkage piston 34 puts an outward force on pin 64, encouraging it to move in the manner illustrated in FIG. 2.

Link 66 has a special shape so that it may engage a groove 72 in the sleeve 74 which is to be shifted. In the position shown in FIG. 2, the sleeve 74 can be urged downwardly to either open or close an opening in a casing (not shown). Those skilled in the art will appreciate that sleeve 74 has a groove similar to groove 72 at its other end. The apparatus A can be inserted in a reverse orientation to that shown in FIG. 2 so that it may engage the similar groove on the sleeve 74 located at the other end of the sleeve from groove 72 for movement of the sleeve in an opposite direction. The apparatus A can be run in the orientation shown in FIG. 2 and at a later time rerun in the wellbore in a reversed orientation to move the sleeve 74 in the opposite direction. Alternatively, an assembly can be put together so that the apparatus A can be stacked upon itself, with one of the assemblies oriented in a manner shown in FIG. 2 and the other in a reversed orientation. In that situation, one or more ball seats, such as 14, can be provided, having differing dimensions to allow sequential operations of various assemblies of the apparatus A at different times as desired. Restricting orifices can be used as an alternate.

Figure 2:
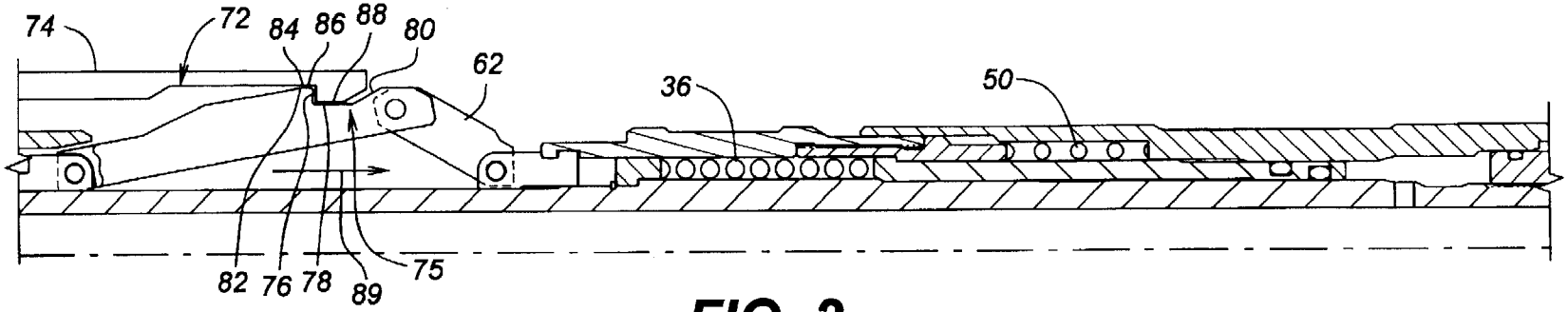
FIG. 2 is the view in FIG. 1, with the tool in the shifted or engaged position with the groove on the sliding sleeve.

Referring now to FIGS. 1 and 2, it should be noted that the link 66 has an outwardly facing groove 75 which is defined by surfaces 76, 78, and 80. The angle between the surfaces 76 and 78 is close to a 90° angle ranging to an acute angle. The angle between surfaces 78 and 80 is obtuse. As a result, surface 76, along with surface 82, defines a projection 84 which, when link 66 is rotated to the position shown in FIG. 2, extends into groove 72 of sleeve 74. In the retracted or first position shown in FIG. 3 for link 66, surface 78 is oriented with a negative slope, indicated in FIG. 3 by arrows 108. When link 66 rotates to engage sleeve 74, surfaces 82 and the bottom 86 of groove 72 windup facing each other in a parallel or nearly parallel orientation to facilitate grip on the sleeve 74. It should be noted that the angle or movement of link 66 is fairly small, in the range of approximately 10°, at the time surface 82 extends into groove 72. At that time, it is preferred that the alignment of surface 82 is parallel to surface 86 which forms a part of groove 72. With the parts so configured, the rotational motion of link 66 puts surface 82 into groove 72 in the same orientation as if the groove 75 translated radially outwardly. The angular rotation of link 62 is greater than the angular rotation of link 66 and is in the order of approximately 30° in the position shown in FIG. 2 in the preferred embodiment. The translational movement of link 60 is quite small, in the order of three eights of an inch. This minimal longitudinal movement of linkage piston 34 reduces wear on seals 24 and 26. It should be noted that prior designs involving shifting sleeves, which in one way or the other were used in conjunction with spring-loaded dogs, involve longitudinal movements of such sleeves of as much as two inches and more, which caused a greater wear rate on the sealing mechanisms involved.

In the preferred embodiment, it is desirable to have the groove 75 in alignment with projection 88 which forms the end of the sleeve 74 to be shifted. When the links 62 and 66 are extended to the position shown in FIG. 2 and are aligned as previously described, jarring motions in the direction of arrow 89 further increased the grip of the linkage, comprised of links 62 and 66, to the sleeve 74.

It should be noted that while one linkage and actuating mechanism have been illustrated, a plurality of linkages distributed around the circumference of the tool is contemplated. Each of the linkages has an equivalent to the links illustrated in FIGS. 1 and 2. Each such linkage is in turn connected to upper segment 52 of the linkage piston 34 for tandem actuation. When disposed, as in the preferred embodiment, at 90° intervals and simultaneously actuated by the linkage piston 34, the outward movement of the identical linkages 62 and 66 acts to centralize the apparatus A within the sleeve 74, as well as to distribute the forces all around the sleeve 74 to facilitate its movement in the uphole or downhole direction with an application of a uniform force around its circumference.

Figure 3:
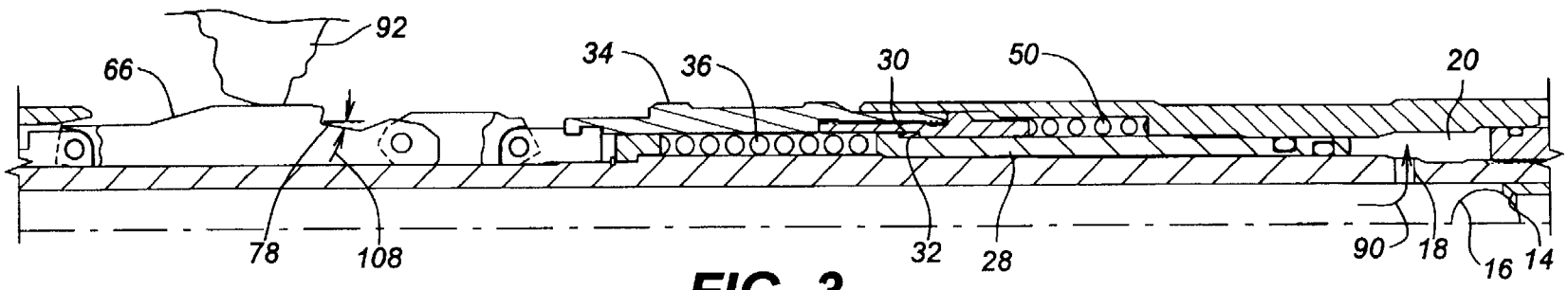

In operation, the passage 12 should be obstructed so that hydraulic pressure can be built up in passageway or port 18. This is accomplished by dropping a ball or sphere 16 onto a ball seat 14 or in any other way obstructing the passage 12. A restricting orifice which creates a backpressure is another way to build pressure. Pressure is built up from the surface which communicates with variable-volume cavity 20 through the port 18. Upon an increase in pressure, as represented by arrow 90, the retaining piston 28 shifts from the position shown in FIG. 1 to the position shown in FIG. 2. In so doing, it compresses the spring 36. Once the force applied by spring 36 on retaining piston 28 is defeated, spring 50 is now free to move the linkage piston 34 until such time as shoulder 32 again contacts shoulder 30 on the retaining piston 28 or link 66 contacts the groove 72, whichever occurs first. As long as the pressure is maintained in port 18, the retaining piston 28 is taken out of consideration and the linkage piston 34 is free to translate against the opposing force of spring 50. Accordingly, the apparatus A may be run into the wellbore under pressure, such as when it is run on a coiled tubing. If any obstructions are encountered as the apparatus A is run into the wellbore, the obstructions would then impact link 66 and force it back toward the position shown in FIG. 1 from the position shown in FIG. 2, temporarily overcoming the force of spring 50. Once the obstruction is cleared, the link 66 can then rotate back outwardly under the force applied indirectly through spring 50 through the linkage. FIG. 3 illustrates running in while under pressure, with arrow 90 indicating pressure applied. It can be seen that there is a gap between shoulders 30 and 32. This is because the link 66 is pushed back into the run-in position when hitting an obstruction 92 schematically illustrated in FIG. 3. It can be readily appreciated that as long as the pressure represented by arrow 90 is maintained, link 66 will again rotate radially outwardly in a counterclockwise manner once it clears the obstruction 92. In the position shown in FIG. 3, the piston 34 has a range of motion available represented by the gap between shoulders 30 and 32.

Figure 4:
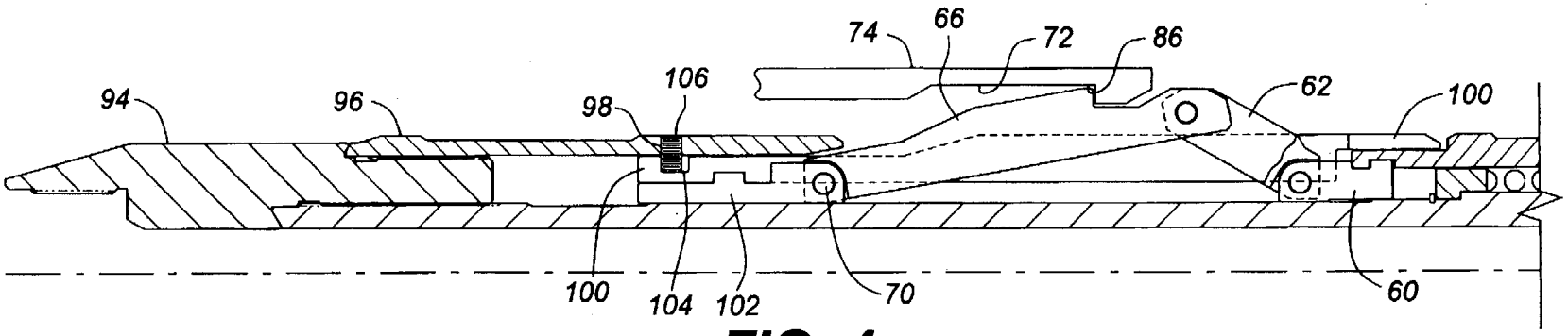
FIG. 4 illustrates the apparatus A in section view, showing in more detail the position of the components when it is engaged in the sleeve.
Figure 5:
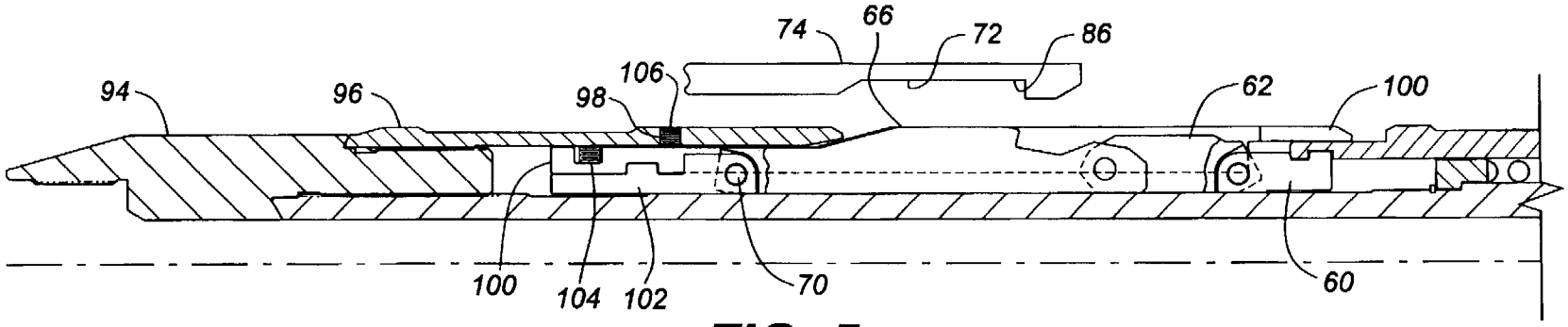
FIG. 5 is the view of FIG. 4 after an emergency shear release, showing the movement of the parts after the pin is sheared.

There is an emergency release feature which is also illustrated in FIGS. 2, 4 and 5. As shown in FIGS. 4 and 5, mandrel 10 has a top sub 94 to which is connected an outer sleeve 96. Extending through outer sleeve 96 is a bore 98. A guiding sleeve 100 is disposed between outer sleeve 96 and anchor sleeve 102. Anchor sleeve 102 supports pin 70 to which link 66 is connected. At its lower end, guiding sleeve 100 extends over link 60 to guide it in its longitudinal movement. Guiding sleeve 100 further has a recess 104 which is aligned with bore 98 of sleeve 96. A shear screw 106 extends through bore 98 into recess 104 to secure the position of guiding sleeve 100. As shown in FIG. 4, the guiding sleeve 100 is locked against anchor sleeve 102, which would otherwise translate but for the existence of shear screw 106. When an emergency release is desired, a sufficient downward jarring force is applied while the apparatus A is in the position shown in FIG. 4. When sufficient stress is transmitted through the top sub 94 to the outer sleeve 96, the shear pin 106 can shear. Once that occurs, the assembly of the guiding sleeve 100 and anchor sleeve 102 are free to translate toward top sub 94. Once this occurs, pin 70 moves longitudinally toward top sub 94, thus retracting the linkage by allowing link 66 to rotate in a clockwise direction. It should be noted that the outer sleeve 96 further promotes the clockwise rotation of link 66 when shear pin 106 is sheared since movement of pin 70 toward top sub 94 rotates link 66 into alignment with outer sleeve 96 so that link 66 can advance under sleeve 96. Eventually, when sufficient clockwise rotation of link 66 has occurred to disengage from the groove 72 of sleeve 74, the apparatus A may be retrieved. Pulling upon top sub 94 facilitates this disengagement. It should also be noted that in the emergency release procedure, shear pin 106 is sheared which encourages the entire linkage to move toward and partially within outer sleeve 96, thereby instituting the clockwise rotation of link 66 to facilitate the disengagement from the groove 72 of sleeve 74. These motions are illustrated in more detail in FIGS. 4 and 5. The use of coil springs reduces failure which occurred in prior designs using leaf or small wire springs. Using the pivot action of links 66 and 62 increases the mechanical advantage of the force applied by spring 50. A more compact design is presented which can service a range of sleeve sizes. Wear on seals 24 and 26 is minimized as a very small longitudinal movement is magnified by a far greater radial movement of links 62 and 66.

The foregoing disclosure and description of the invention are illustrative and explanatory thereof, and various changes in the size, shape and materials, as well as in the details of the illustrated construction, may be made without departing from the spirit of the invention.

I claim:

1. In combination a downhole sleeve having a groove and a tool for downhole shifting the sleeve wherein:

said tool further comprises a body;

at least one gripping member mounted to said body;

a biasing member mounted to said body and acting on said gripping member;

said gripping member moving by virtue of said bias into said groove on said sleeve and configured in a manner so that the gripping force of said gripping member on said groove is not reduced as a result of the movement of said gripping member into said groove on said sleeve;

whereupon a jarring force applied to said body with said gripping member extended into said groove shifts said sleeve.

2. The tool of claim 1, wherein:

said body is elongated having a longitudinal axis;

said biasing member applies a force in a direction along said longitudinal axis as said gripping member is urged toward the downhole equipment.

3. A tool for shifting downhole equipment, comprising:

a body;

at least one gripping member mounted to said body;

a biasing member mounted to said body and acting on said gripping member;

said gripping member moving toward the downhole equipment and configured in a manner so that the gripping force on the downhole equipment is not reduced as a result of the movement of said gripping member toward the downhole equipment;

said body is elongated having a longitudinal axis;

said biasing member applies a force in a direction along said longitudinal axis as said gripping member is urged toward the downhole equipment;

said gripping member comprises a linkage which is pivoted toward the downhole equipment by said biasing member;

said linkage comprises a gripping link rotatably movable between a first position where it is aligned with said body and a second position wherein it is angularly displaced from said body and in contact with the downhole equipment;

said gripping link is formed having a projection thereon oriented away from said body, said projection extending into a depression in the downhole tool for operation thereof;

said biasing member further comprises:

a first spring acting on a translating linkage piston;

a transfer link connected at a first pivot point to said linkage piston and at a second pivot point to said gripping link;

whereupon translation of said linkage piston, said transfer and gripping links rotate in opposite directions about said second pivot point, moving said second pivot point away from said body.

4. The tool of claim 3, wherein:

said linkage piston further comprises:

a translating link movable along said body by said linkage piston;

said transfer link attached to said translating link at said first pivot point.

5. The tool of claim 4, wherein:

a retaining sleeve movable along said body and biased by a second spring to contact said linkage piston and move said linkage piston to a first position where said first spring is compressed and said gripping link is in said first position.

6. The tool of claim 5, further comprising:

means for shifting said retaining sleeve from a first position where said retaining sleeve urges said linkage piston to its said first position, and a second position where said retaining sleeve moves to compress said second spring to allow said first spring to translate said linkage piston to a second position, whereupon said gripping link is in turn urged toward its said second position.

7. The tool of claim 6, wherein:

said means for shifting further comprises:

a seal assembly to sealingly mount said retaining sleeve to said body in a manner where a variable-volume cavity is created, whereupon application of pressure to said cavity said retaining sleeve is shifted to its said second position.

8. The tool of claim 7, further comprising:

a bore through said body;

an orifice in said bore, said body formed having a passageway from said bore into said variable-volume cavity;

said orifice creating a backpressure to allow said retaining sleeve to be moved.

9. In combination, a sleeve having a groove thereon and a shifting tool for shifting the sleeve when located in a wellbore, wherein:

said tool further comprising a body;

at least one gripping member movable between a first position adjacent said body and a second extended position away from said body and into said groove;

at least one biasing member for selective application of a force to said gripping member, said applied force not decreasing upon movement of said gripping member from said first to said second position;

said body responsive to an applied jarring force thereto to move said gripping member while in its said second position to in turn move said sleeve.

10. A shifting tool for a shifting sleeve, comprising:

a body;

a biased linkage selectively movable by pivoting action between a first retracted position and a second extended position in contact with the sleeve;

said linkage comprising a gripping link which rotates on a pivot between said first and second positions, said gripping link having a longitudinally asymmetric shape and a depression, said depression, when said gripping link is in its said first position, having a bottom surface with negative slope with respect to the sleeve, whereupon rotation of said gripping link said depression presents itself in substantial alignment with a projection on said sleeve.

11. The tool of claim 10, further comprising:

a retaining element to hold said linkage in said first position;

fluid-actuated means for overcoming said retaining element, allowing said biased linkage to move between said first and second positions to clear an obstruction as the tool is run into the wellbore.

12. A tool for shifting downhole equipment, comprising:

a body;

at least one gripping member mounted to said body;

a biasing member mounted to said body and acting on said gripping member;

said gripping member moving toward the downhole equipment and configured in a manner so that the gripping force on the downhole equipment is not reduced as a result of the movement of said gripping member toward the downhole equipment;

said body is elongated having a longitudinal axis;

said biasing member applies a force in a direction along said longitudinal axis as said gripping member is urged toward the downhole equipment;

said gripping member comprises a linkage which is pivoted toward the downhole equipment by said biasing member;

said body, when subjected to a jarring force with said gripping member engaging the downhole equipment, actuates said downhole equipment by tandem movement of said body with the downhole equipment.

13. The tool of claim 12, wherein:

said linkage comprises a gripping link rotatably movable between a first position where it is aligned with said body and a second position wherein it is angularly displaced from said body and in contact with the downhole equipment.

14. The apparatus of claim 13, wherein:

said gripping link is formed having a projection thereon oriented away from said body, said projection extending into a depression in the downhole tool for operation thereof.

15. A shifting tool for shifting a sleeve having a groove thereon when located in a wellbore, comprising:

a body;

at least one gripping member movable between a first position adjacent said body and a second extended position away from said body;

at least one biasing member for selective application of a force to said gripping member, said applied force not decreasing upon movement of said gripping member from said first to said second position;

said gripping member comprises a linkage pivotally mounted on a first end to a block which is selectively fixed to said body;

said biasing means comprises a first spring-biased piston mounted to translate on said body, said linkage having a second end pivotally mounted to said piston;

said piston, as a result of translation, rotating said linkage between said first position and said second position to engage said linkage into the groove in the sleeve.

16. The tool of claim 15, wherein:

said body may be advanced and can clear obstructions which engage said linkage when it is in said second position prior to engaging the groove in the sleeve, said clearing obstructions occurring due to rotation of said linkage temporarily rarily toward said first position until the obstruction is passed, whereupon said first spring biased piston urges said linkage to its said second position.

17. The tool of claim 16, further comprising:

a shearing member to selectively fix said block to said body;

whereupon, to secure a release from said sleeve by said linkage in its said second position, said shearing member is broken, allowing said block to translate and said linkage to move toward its said first position.

18. The tool of claim 17, wherein:

said linkage comprises a gripping link having a longitudinally asymmetric shape and a depression, said depression, when said gripping link is in its said first position, having a bottom surface with negative slope with respect to the sleeve, whereupon rotation of said gripping link said depression presents itself in substantial alignment with a projection on the sleeve.

19. The tool of claim 15, further comprising:

a retaining sleeve biased by a second spring, which is stronger than said first spring, into contact with said piston until fluid pressure applied to said body overcomes said second spring by moving said retaining sleeve and allows said first spring to bias said piston to position said linkage in its said second position.

20. The tool of claim 15, wherein:

said linkage comprises a gripping link, said gripping link having a longitudinally asymmetric shape and a depression, said depression, when said gripping link is in its said first position, having a bottom surface with negative slope with respect to the sleeve, whereupon rotation of said gripping link said depression presents itself in substantial alignment with a projection on the sleeve.

* * * * *